United States Patent [19]

Babb

[11] 4,205,205

[45] May 27, 1980

[54] DYNAMIC LOUDSPEAKER HAVING MAGNETIC ASSEMBLY ADHESIVELY BONDED WITHIN A SURROUNDING BASKET

[75] Inventor: Burton A. Babb, Dallas County, Tex.

[73] Assignee: Babbco, Ltd., Richardson, Tex.

[21] Appl. No.: 914,782

[22] Filed: Jun. 12, 1978

[51] Int. Cl.[2] ..... H04R 9/06; H04R 31/00

[52] U.S. Cl. ..... 179/115.5 R; 29/594; 179/115.5 SF

[58] Field of Search ..... 179/115.5 R, 115.5 PC, 179/115.5 SF, 117, 119 R, 120; 29/594

[56] References Cited

U.S. PATENT DOCUMENTS

| | | | |
|---|---|---|---|
| 3,125,647 | 3/1964 | Rouy | 179/115.5 R |
| 3,150,441 | 9/1964 | Kloss | 179/115.5 R |
| 3,851,118 | 11/1974 | Kleis et al. | 179/155.5 PC |
| 3,953,687 | 4/1976 | Carbonneau | 179/119 R |
| 4,029,911 | 6/1977 | Albinger | 179/115.5 ES |

FOREIGN PATENT DOCUMENTS

| | | | |
|---|---|---|---|
| 920014 | 9/1954 | Fed. Rep. of Germany | 179/115.5 R |
| 2202509 | 7/1973 | Fed. Rep. of Germany | 179/115.5 PC |
| 939636 | 11/1948 | France | 179/115.5 R |
| 1145557 | 10/1957 | France | 179/115.5 R |
| 240425 | 4/1926 | United Kingdom | 179/115.5 R |
| 244051 | 7/1926 | United Kingdom | 179/115.5 R |

*Primary Examiner*—George G. Stellar

*Attorney, Agent, or Firm*—Hubbard, Thurman, Turner, Tucker & Glaser

[57] ABSTRACT

A loudspeaker is constructed by circumferentially bonding a magnetic assembly in coaxial alignment rearward within a frame and installing an acoustic radiator assembly at a forward end of the frame, the acoustic radiator assembly having a cylindrical member about which a voice coil is wound, the cylindrical member extending rearward into an annular flux gap in the magnetic assembly such that the voice coil is disposed in proper alignment within the annular flux gap by virtue of the cylindrical member bearing against a mating surface of the magnetic assembly, thereby bringing the acoustic radiator assembly into substantially coaxial alignment with respect to the frame to facilitate suspension thereof at the forward end of the frame.

13 Claims, 13 Drawing Figures

DYNAMIC LOUDSPEAKER HAVING MAGNETIC ASSEMBLY ADHESIVELY BONDED WITHIN A SURROUNDING BASKET

BACKGROUND OF THE INVENTION

The present invention pertains generally to loudspeakers, and more particularly to an improved system for aligning and supporting a magnetic assembly in a loudspeaker of the type which reciprocates a coil through an annular flux gap in response to a current through the coil.

A representative prior-art loudspeaker is described in U.S. Pat. No. 3,983,337, wherein an annular flux gap is formed in part by a metal loop which is both expensive to fabricate and undesirably bulky. A frame supports a forward end of the metal loop, which in turn cantilevers back therefrom to provide support for a magnet and center pole. An additional problem with a magnetic assembly of such construction is the difficulty in achieving proper alignment of the various parts, which is necessary for reliable sound reproduction.

Embodied in a more recent design, described in my co-pending application Ser. No. 669,315, now U.S. Pat. No. 4,115,667, are various improvements over the above-mentioned loudspeaker including, for example, a more compliant suspension system and lighter weight acoustic radiator assembly. Such improvements provide increased electromagnetic drive efficiency, which in turn permits the employment of a simplified, lighter weight magnetic assembly. Briefly, the magnetic assembly described therein comprises a toroidal shaped permanent magnet, adjoining toroidal shaped front and back pole plates, a cylindrical center post affixed to the back pole plate and extending forward through the magnet and front pole plate to provide an annular flux gap between the adjacent surfaces of the front pole plate and center post, and a frame mounted on the forward-most major surface of the front pole plate for supporting an acoustic radiator assembly including radiating surfaces and a voice coil.

In spite of the significant improvements over the prior-art loudspeaker, this more recent design still presents certain problems. In particular, alignment of the various component parts of the loudspeaker has proved difficult and time consuming. The use of a fast curing adhesive (cyanoacrylate) at the interfaces between the magnet and pole plates requires special alignment fixtures. Furthermore, in order to assure proper alignment of the acoustic radiator assembly with respect to both the frame and the magnetic assembly, special attention must be given to aligning the frame with respect to the front pole plate.

SUMMARY OF THE INVENTION

An important object of the present invention is to provide a loudspeaker that eliminates the above-mentioned alignment problems and is less expensive to produce without diminishing the quality of sound reproduction.

Another object of the invention is to provide a loudspeaker having a frame that encompasses the periphery of a magnetic assembly such that at least one of the members of the magnetic assembly will be automatically self-aligned by merely installing it in the frame.

Yet another object of the invention is to provide a loudspeaker having a circumferentially bonded magnetic assembly that eliminates the need for adhesive between the contacting faces thereof, thereby reducing reluctance at the contacting faces and providing a corresponding increase in magnetic flux in the annular flux gap for driving the voice coil while additionally providing a more economical loudspeaker construction.

These and other objects and advantages are accomplished in accordance with the present invention by providing a frame having a major axis defining the direction of movement of a reciprocating voice coil, the frame being structured such that an annular flux gap formed between adjacent surfaces of members of a magnetic assembly will be coaxially aligned with respect to the major axis by virtue of at least one of the members of the magnetic assembly being held in position by engagement with adjacent walls of the frame prior to being rigidly secured therein.

In the presently most preferred loudspeaker embodiment and method of construction, a cylindrical center post is coaxially preassembled with a toroidal shaped back pole plate. The preassembled members are then installed in the frame and self-aligned with respect thereto by engagement with the walls of the frame. A toroidal shaped magnet is then installed in the frame atop the back pole plate and likewise self-aligned by engagement with the walls of the frame. Next, a toroidal shaped front pole plate is installed in the frame atop the magnet and aligned relative to the center post by placing a collar of precise thickness therebetween. An adhesive bonding material is then formed in situ in the spaces between the walls of the frame and the outer edges of the magnet and pole plates, thereby securing the magnet and pole plates in coaxial alignment relative to the frame. Accordingly, the collar can then be removed to reveal an annular flux gap coaxially aligned with respect to the frame in the space between the front pole plate and the center post. Finally, the acoustic radiator assembly is installed in the frame, the acoustic radiator assembly including a voice coil extending rearward from radiating surfaces into the annular flux gap, whereby a cylindrical member around which the voice coil is wound bears against the cylindrical surface of the center post thus bringing the entire acoustic radiator assembly into coaxial alignment with respect to the frame and allowing the acoustic radiator assembly to be peripherally suspended from a forward end of the frame to maintain proper coaxial alignment of the voice coil in the annular flux gap.

Additional advantages and novel features of the present invention may be best understood by reference to the following detailed description of several illustrative embodiments thereof.

BRIEF DESCRIPTION OF THE DRAWINGS

FIG. 8 is a perspective view of an alignment tool for use in the preferred method of construction;

Figure 1:
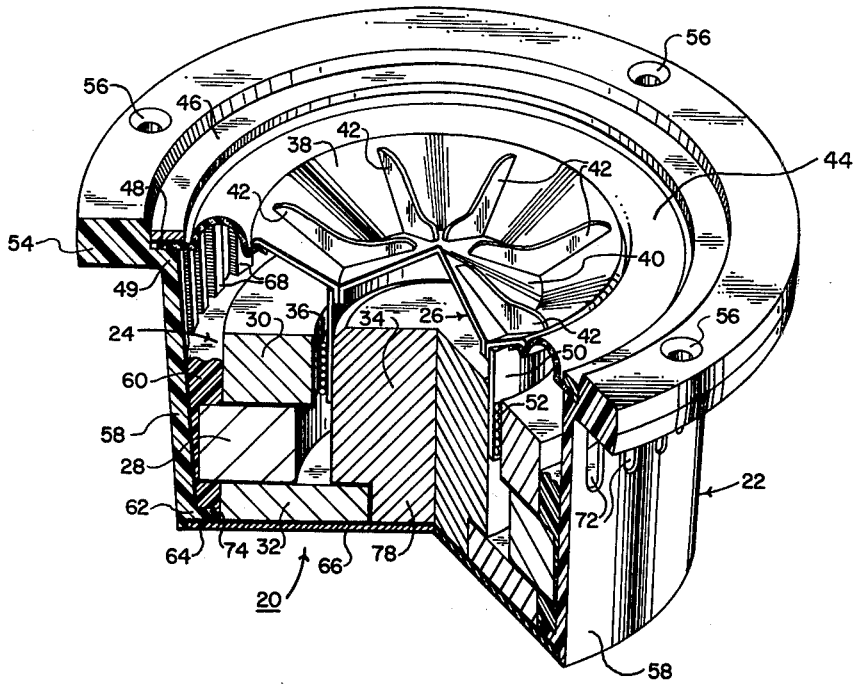
FIG. 1 is a perspective view of a loudspeaker in accordance with the present invention wherein a section is removed to reveal internal structural features.

In the schematic sectional views of FIGS. 3–7, 9 and 11–13, the background details of the frame are not included for ease of illustration. Such background details are similar in most respects to those shown in the view of FIG. 2.

DESCRIPTION OF THE PREFERRED EMBODIMENTS

Referring now to the drawings, wherein like reference numerals designate like parts, the presently preferred embodiment of the invention as well as various alternative embodiments thereof will be described.

With particular reference to FIG. 1, a preferred loudspeaker embodiment, which is designated generally by reference numeral 20, is illustrated with a section cut away to reveal its unique internal construction. The loudspeaker 20 comprises a frame or housing 22, a magnetic driver assembly generally designated by numeral 24, and an acoustic radiator assembly generally designated by numeral 26.

The magnetic driver assembly 24 comprises a permanent magnet 28 having magnetic poles on its opposed major surfaces at which are disposed front and back pole plates 30 and 32, all of which are generally toroidal in shape, and further comprising a center post 34 affixed to the back pole plate 32 and extending inwardly through the magnet 28 and front pole plate 30. The contacting surfaces between adjacent members of the magnetic driver assembly 24 are machined to minimize magnetic flux impedance. It will be appreciated that an annular flux gap 36 is formed between the adjacent surfaces of the front pole plate 30 and the center post 34.

The acoustic radiator assembly 26 is preferably of the type described in commonly assigned application Ser. No. 669,315, now U.S. Pat. No. 4,115,667, entitled "Broad Band Dynamic Loudspeaker", filed by Burton A. Babb on Mar. 22, 1976, the terms of which are hereby incorporated by reference. Briefly, the preferred acoustic radiator 26 has a mechanical-acoustic transducer comprising a plurality of radiating surfaces including a speaker cone 38, a dust cap 40 centrally disposed within the speaker cone 38, and an arrangement of high audio frequency transmission ribs 42 spanning the speaker cone 38 and dust cap 40 as shown. The speaker cone 38 is suspended at its periphery by a highly compliant rolled edge seal 44, which is adhesively secured between a clamp ring 46 and a recessed shoulder 48 on a forward end 49 of the frame 22. Extending rearward from the juncture of the speaker cone 38 and the dust cap 40 is a cylindrical member 50 about which is wound a voice coil 52. The cylindrical member 50 slideably bears against the center post 34 to provide axial suspension for the acoustic radiator 26 as the voice coil 52 reciprocates in the annular flux gap 36, the interacting magnetic fields therein being the medium for electrical-mechanical transducer action as will be appreciated by those skilled in the art. The dimensions of the annular flux gap 36 and the voice coil 52 are greatly enlarged for ease of illustration. Likewise, the members 38, 40 and 50 are illustrated much thicker than they would appear in actuality. Preferred dimensions and other details of construction and operation of the acoustic radiator 26 are given in application Ser. No. 669,315 now U.S. Pat. No. 4,115,667.

The frame 22 is a unitary construction preferrably comprising injection molded plastic; although cast aluminum, while more expensive, provides an equally desirable frame construction. Extending outwardly from the recessed shoulder 48 is a peripheral flange 54, which is provided with holes 56 for mounting the loudspeaker 20 in a suitable baffle (not shown).

In accordance with an important feature of the invention, the frame 22 has sidewalls 58 that extend rearward from the flange 54 to encompass the magnetic assembly 24. An adhesive material 60 bonds the outer edges of the magnetic assembly members 28, 30 and 32 to the walls 58 such that the frame 22 provides circumferential support for the magnetic assembly 24. A rearward end 62 of the walls 58 is provided with a shelf 64 for receiving and locating a backing sheet or base membrane 66 for covering the magnetic assembly 24. The backing sheet 66 preferably comprises a heavy gauge aluminum foil, but alternatively can be plastic or a suitable papery material. The functional significance of the backing sheet 66 is described below in conjunction with a preferred method of making the loudspeaker 20.

Figure 2:
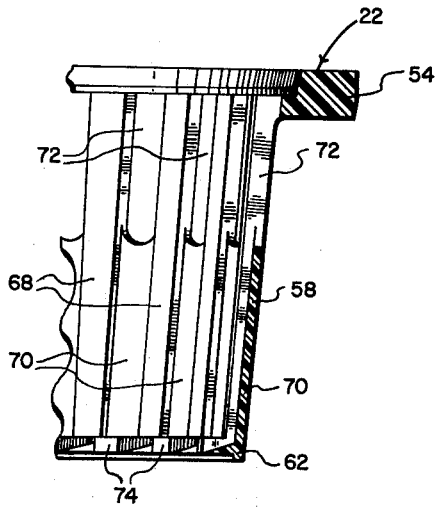
FIG. 2 is a section of a portion of the frame used in the loudspeaker of FIG. 1 taken through a window at a forward end of the frame.

Now referring to FIG. 2, additional details of the preferred frame 22 will be described. The walls 58 are preferably tapered very slightly in the manner shown to provide a generally frusto-conical shape of greatest diameter at the forward end 49 near the flange 54 and decreasing in diameter while moving toward the rearward end 62. The walls 58 are segmented into regularly spaced ribs 68, which are interconnected at the rearward end 62 by recessed webs 70. Windows or vents 72 are provided at the forward end 49 between adjacent ribs 68 by virtue of the webs 70 terminating at a point along the length of the walls 58. The vents 72 permit the air mass inside the loudspeaker 20 to communicate with a surrounding air mass, which may be enclosed or baffled as will be appreciated by those skilled in the art. At the rearmost ends of the ribs 68 are feet 74, which project generally radially inward to locate the back pole plate 32 as depicted in FIG. 1, thereby providing a precise coaxial alignment of the center post 34 relative to the frame walls 58. The front pole plate 30 is precisely located relative to the center post 34 prior to bonding with the adhesive 60 as will be described more fully below, thereby providing a uniform annular flux gap 36 in the space between the adjacent surfaces of the front pole plate 30 and the center post 34.

Figure 3:
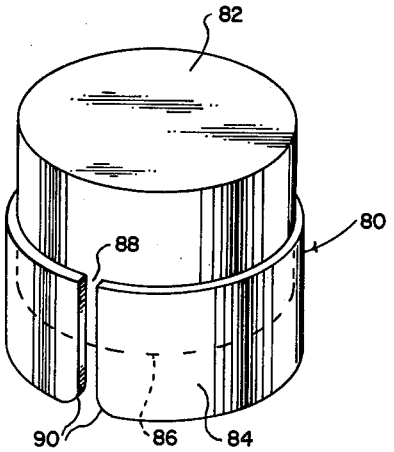
FIGS. 3–7 are schematic sectional views of a rearward portion of the inventive loudspeaker resting atop a work surface and illustrating sequential steps in a preferred method of construction.
Figure 3:
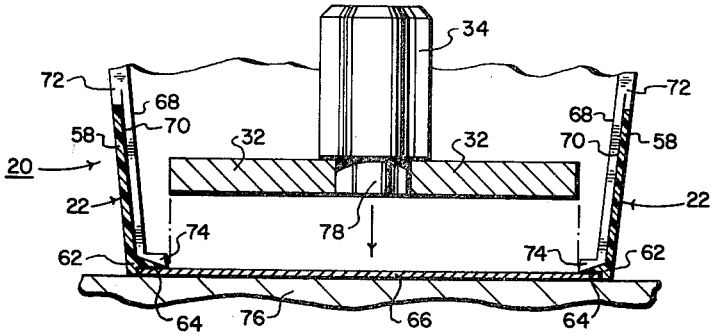
Figure 4:
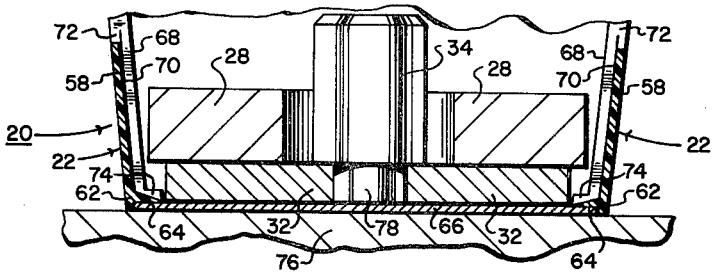

Now referring to FIGS. 3–7, a preferred method of making the loudspeaker 20 will be described. With particular reference to FIG. 3, the frame 22, with the backing sheet 66 adhesively secured thereto at the shelf 64, is placed in the orientation shown on a table or suitable flat work surface 76. Then, the back pole plate 32 and center post 34, which are preassmbled preferrably by force fitting a stud extension 78 of the center post 34 into the back pole plate 32, are lowered in the manner indicated onto the backing sheet 66. A nominal displacement of 0.025 cm. between the outer edges of the back pole plate 32 and the adjacent edges of the projecting feet 74 assures proper coaxial alignment of the center post 34 with respect to the frame 22. The magnet 28 is then placed on the back pole plate 32 as depicted in FIG. 4 wherein it is seen that the ribs 68 serve to maintain the magnet 28 in generally coaxial alignment with respect to the center post 34. It is not necessary that the magnet 28 be aligned with as tight a tolerance as the other members of the magnetic assembly 24. In fact, the magnet 28 is intentionally designed to have a slightly greater range of potential misalignment than the back pole plate 32 in order to assure that the magnet 28 will not ride up on the ribs 68 so as to produce an unwanted gap between the magnet 28 and back pole plate 32.

Figure 5:
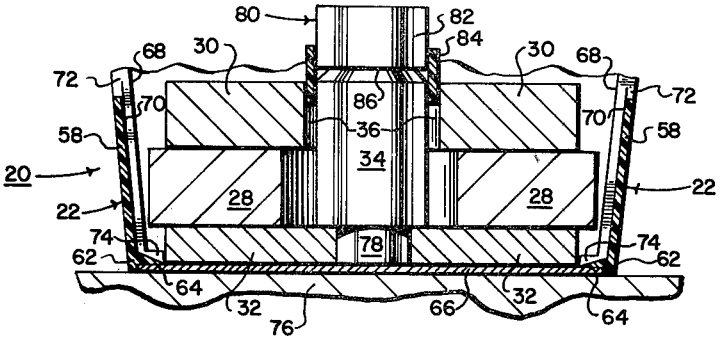

In accordance with a unique aspect of the inventive method, a specially adapted tool 80 is used to precisely align the front pole plate 30 with respect to the center post 34 as depicted in FIG. 5. The tool 80 comprises a cylindrical handle 82 and a tubular collar 84 extending beyond a bottom surface 86 of the handle 82. The diameter of the handle 82 is the same as that of the center post 34, and the thickness of the collar 84 equals the nominal separation distance between the adjacent surfaces of the front pole plate 30 and the center post 34. Thus, a reasonably precise coaxial alignment of the front pole plate 30 relative to the center post 34 can be readily achieved by first installing the front pole plate 30 and then inserting the tool 80 in the manner shown with the bottom surface 86 of the handle 82 resting atop the center post 34 and the collar 84 extending at least partially into the gap 36.

A preferred tool 80 suitable for the above alignment step is separately illustrated in FIG. 8. The handle 82 is conveniently formed by machining a metal bar to the desired diameter. The collar 84 is conveniently formed by tightly wrapping and adhesively securing a sheet of flexible plastic of desired thickness around the handle 82 such that a longitudinal slot 88 remains between opposite ends of the sheet. The slot 88 not only permits the collar 84 to be tightly wrapped around the handle 82, but also provides rounded corners 90 that facilitate insertion of the collar 84 into the gap 36.

Figure 6:
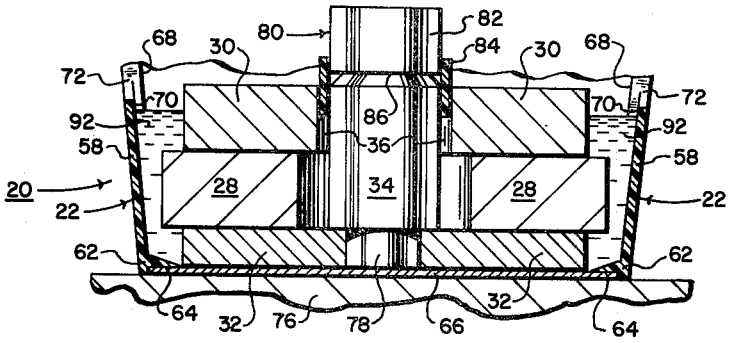
Figure 7:
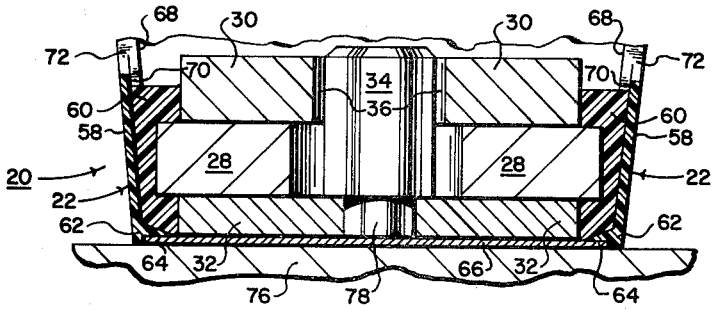

With the members of the magnetic assembly 24 aligned in the above described manner, a liquid adhesive material 92 is poured into the frame 22 around the peripheral edges of the magnetic assembly members 28, 30 and 32, as depicted in FIG. 6. The recessed webs 70 serve to facilitate the flow of the liquid adhesive 92 down past the edges of the magnet 28 to fill the spaces between the back pole plate 32 and the walls 58. The backing sheet 66 serves to retain the liquid adhesive material 92 inside the frame 22. Thus, it will be appreciated that the backing sheet 66 should be adhesively secured to the shelf 64 in a manner that provides a fluid tight seal thereat. The liquid adhesive material 92 preferably comprises a room temperature curing epoxy or other suitable bonding material that may be poured into the frame and will set up in place. When the adhesive 92 has hardened sufficiently as depicted by numeral 60 in FIG. 7, the tool 80 can be removed and the members of the magnetic assembly 24 will maintain their position relative to each other and to the frame 22 by virtue of the adhesive 60 bonding the magnetic assembly 24 to the frame walls 58.

Now referring again to FIG. 1 and with the above description of the method of constructing the loudspeaker 20 in mind, the unique self-alignment features of the present invention will become apparent. In particular, the feet 74 assure that the back pole plate 32 is coaxially aligned with respect to the frame 22. Thus, the center post 34, which is preassembled in coaxial alignment with the back pole plate 32, is also coaxially aligned with respect to the frame 22. The front pole plate 30, having been aligned with respect to the center post 34 using the tool 80 prior to bonding with the adhesive 60, is also coaxially aligned with respect to the frame 22, thereby providing a uniformly dimensioned, coaxially aligned annular flux gap 36. Thus, when the voice coil 52 is inserted in the annular flux gap 36, the engagement of a bearing surface of the cylinder 50 against the center post 34 assures that the entire acoustic radiator 26 is also substantially in coaxial alignment with the frame 22 so that the periphery of the rolled edge 44 will come to rest in proper position on the shoulder 48. However, prior to clamping the rolled edge 44 to the shoulder 48, the acoustic radiator 26 is manually reciprocated once or twice to allow the mating surfaces of the cylinder 50 and the center post 34 to interact, thereby automatically making a fine adjustment of the position of the acoustic radiator assembly 26 relative to the frame 22. It will be appreciated that sufficient tolerance is provided in the area of the shoulder 48 to allow the periphery of the rolled edge 44 to move slightly in response to such fine adjustment without engaging the adjacent edge of the flange 54. Thereafter, when the clamp ring 46 secures the rolled edge 44 at the shoulder 48, the cylinder 50 will be maintained in precise coaxial alignment with respect to the center post 34.

Figure 9:
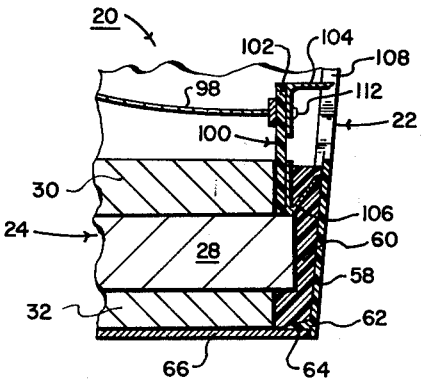
FIG. 9 is a schematic sectional view of the loudspeaker of FIG. 1 taken through an area including a terminal block.

FIG. 9 illustrates a section through a rear corner portion of the above described loudspeaker 20 at a point where a wire lead 98 extends generally radially outward from the voice coil 52 to a terminal block 100 for making a first electrical connection to the voice coil 52. It will be appreciated that a similar arrangement (not shown) is provided at another location, preferably at the opposite side of the loudspeaker 20, for making a second electrical connection to the voice coil 52.

Figure 10:
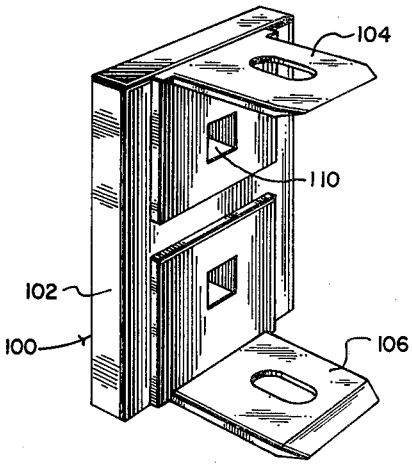
FIG. 10 is a perspective view separately illustrating the terminal block employed in FIG. 9.

The terminal block 100, which is separately illustrated in FIG. 10, comprises a phenolic or other suitable insulating board 102 and a pair of L-shaped metallic terminals 104 and 106. The terminal block 100 is installed in the loudspeaker 20 prior to the above described step of introducing the liquid adhesive 92 into the frame 22, or at least prior to the adhesive 92 hardening. In particular, the terminal block 100 is wedged into the space between the front pole plate 30 and the walls 58 in the manner depected in FIG. 9, the terminal 106 bending to a V-shaped configuration in the process. In this manner, the terminal block 100 is held in place while the adhesive 60 in which it is embedded hardens. Thereafter, the terminal block 100 is secured by the surrounding adhesive 60 with sufficient rigidity to permit the installation of a conventional push-on connector (not shown) onto the terminal 104. Access to the terminal 104 for installing such a connector is provided by a suitably sized window 108, which is typically several times as wide as one of the previously described windows 72. An opening 110 in the terminal block 100 permits the lead 98 to be threaded therethrough and affixed to the terminal 104 by means of a suitable soldered connection 112.

Figure 11:
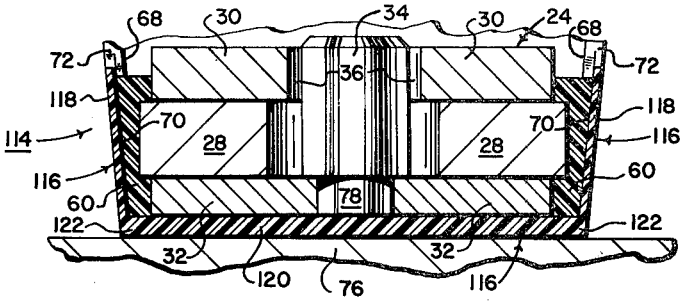
FIG. 11 is a schematic sectional view of a first alternate embodiment of the inventive loudspeaker at a stage of construction corresponding to that shown in FIG. 7.

An alternative loudspeaker embodiment, designated generally by numeral 114, will now be described with reference to FIG. 11. All features of the embodiment 114 are identical to those of the previously described embodiment 20, with the exception of the presently described features of frame construction. In particular, the loudspeaker 114 comprises a generally cup-shaped frame 116 of injection molded plastic including sidewalls 118 and a circular base 120 integrally formed with the sidewalls 118 to provide a fluid tight structure at a rearward end 122 thereof. The provision of the integrally formed base 120 obviates the need for the separate backing sheet 66 of the previously described embodiment 20. After installing the preassemblied members 32 and 34 in the manner depicted atop the base 120, the construction of the loudspeaker 114 procedes similarly as previously described with reference to the loudspeaker 20. Although the integrally formed base 120 eliminates potential problems with the backing sheet 66 rupturing and/or leaking liquid adhesive 92 (see FIG. 6), the alternative cup-shaped frame construction 116 is more costly than the previously described open-back frame construction 22.

Another alternative loudspeaker embodiment, designated generally by numeral 124, will now be described with reference to FIGS. 12 and 13. The loudspeaker 124 comprises a unitary generally cup-shaped frame 126 of cast aluminum including sidewalls 128 and a circular base 130 adjoining the sidewalls 128 and forming a fluid tight structure at a rearward end 132 thereof. Once again, the need for the previously described separate backing sheet 66 is eliminated. In accordance with an additional unique feature, a magnetic driver assembly 134 comprises: a first back pole plate 136 disposed adjacent to the base 130, a permanent magnet 138 disposed forward from the first back pole plate 136, a first front pole plate 140 disposed forward from the permanent magnet 138, a second back pole plate 142 disposed between the first back pole plate 136 and the permanent magnet 138, a second front pole plate 144 disposed between the first front pole plate 140 and the permanent magnet 138, and a center post 146 affixed to the second back pole plate 142 and extending forward through apertures in the permanent magnet 138 and front pole plates 140 and 144. The center post 146 and the second back pole plate 142 are preferably preassemblied using a threaded fastener 148, which passes through the center of the second back pole plate 142 into a pretapped hole 150 in the center post 146. The first back pole plate 136 is provided with a central aperature 152 permitting a head portion 154 of the fastener 148 to protrude therewithin.

Figure 12:
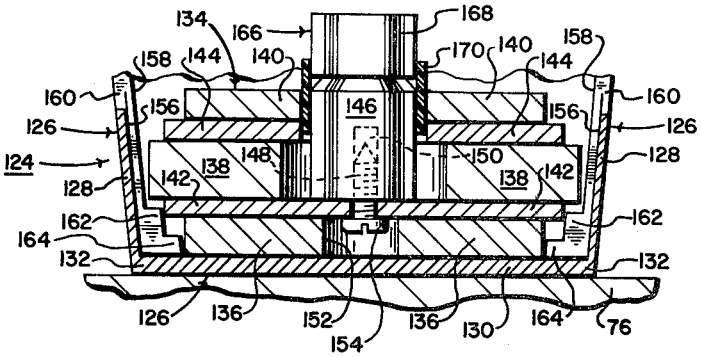
FIGS. 12 and 13 are schematic sectional views of a second alternate embodiment of the inventive loudspeaker at stages of construction corresponding to those shown in FIGS. 5 and 7 respectively.
Figure 13:
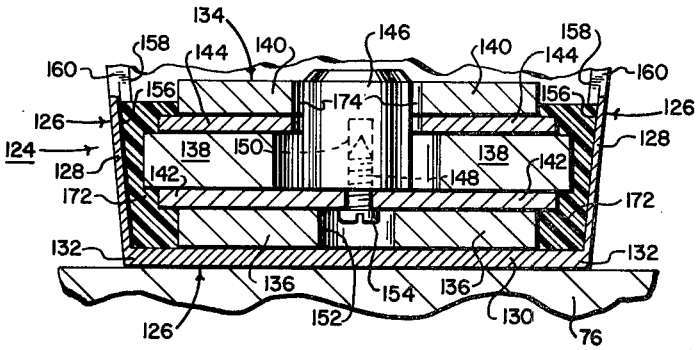

With particular reference to FIG. 12, the loudspeaker 124 is shown at a stage of construction corresponding to that shown in FIG. 5 for the principal loudspeaker embodiment 20. The section of FIG. 12 is taken through the sidewalls 128 at web portions 156, which are recessed between regularly spaced ribs 158 in similar fashion to the previously described webs 70 and ribs 68. Only partially visible are vents 160, which are disposed between adjacent ribs 158 forward from the webs 156 and which serve the same purpose as the previously described vents 72. Below or rearward from each rib 158 are steplike projections 162 and 164, which serve to locate the outer edges of the plates 142 and 136, respectively. The center post 146, by virtue of being affixed to the center of the plate 142, is precisely coaxially aligned with respect to the sidewalls 128 by means of the projections 162 engaging the plate 142 as shown. The ribs 158 serve to maintain the magnet 138 in generally coaxial alignment with respect to the sidewalls 128, and thus also with respect to the other members of the magnetic assembly 134. A tool 166, which is similar to and functions like the previously described tool 80, is used to precisely align the front pole plates 140 and 144 with respect to the center post 146. The tool 166 comprises a cylindrical-shaped handle 168 and an adjoining tubular collar 170, which extends sufficiently beyond the handle 168 to interact with the second front pole plate 144. The loudspeaker 124 is constructed by merely stacking the members of the magnetic assembly 134 in the frame 126 as shown, aligning the front pole plates 140 and 144 using the tool 166, and then pouring a liquid adhesive into the frame 126 around the periphery of the magnetic assembly 134. When the liquid adhesive has hardened to a solid mass 172 as shown in FIG. 13, the tool 166 can be removed to reveal a uniformly shaped annular flux gap 174 in the space between the center post 146 and the front pole plates 140 and 144, the annular flux gap 174 being coaxially aligned with respect to the frame 126. Lastly, it will be appreciated that the construction of the loudspeaker 124 is completed by the installation of an acoustic radiator assembly in similar fashion to the installation of the assembly 26 described above with reference to FIG. 1.

Although the alternative embodiment 124 presents the problem of handling and inventorying several more parts than are required in the manufacture of the principal embodiment 20, other features of the alternative embodiment 124 are relatively advantageous. For example, the magnetic assembly 134 requires relatively less metal since the magnetic flux lines are concentrated by using the multiple pole plate arrangement wherein the diameters thereof decrease in steps in moving away from the magnet 138. Such an arrangement reduces flux fringing, thus improving performance while providing a comparatively lighter weight and less expensive embodiment. Unfortunately, it will be appreciated that the point of diminishing returns is quickly reached since the addition of more parts soon becomes economically and functionally intolerable. It is believed that no more than two front pole plates and two back pole plates can be justified. Furthermore, it will be appreciated that the dual front and back pole plates of the loudspeaker 124 are only presently feasible by virtue of the elimination of the adhesive joints (discussed above in the Background) at the interfaces between adjacent members of the magnetic assembly 134, which would, if present, prohibitively increase magnetic impedance.

Although several preferred embldiments of the invention have been described in detail, it is to be understood that various changes and substitutions can be made and additional alternative embodiments produced in accordance with the invention without departing from the spirit and scope thereof as defined by the appended claims.

What is claimed is:

1. A method of making a loudspeaker comprising the steps:

assembling a center post in coaxial alignment with a back pole plate, installing the assembly of the center post and back pole plate in a frame such that the center post is coaxially aligned with respect to the frame by means disposed on inside walls of the frame for locating peripheral edges of the back pole plate, installing a magnet around the center post in generally coaxial alignment therewith, installing a front pole plate around the center post using a tool to maintain precise spacing between the front pole plate and the center post, pouring a liquid adhesive into the spaces between the inner surfaces of the frame and the peripheral edges of the magnet and pole pieces, allowing the liquid adhesive to harden to a solid mass, removing the tool, installing an acoustic radiator assembly in the frame so that a voice coil at a rearward end of the acoustic radiator assembly extends into and is coaxially aligned within the space between the front pole plate and the center post, and securing a peripheral portion of the acoustic radiator assembly to a forward end of the frame to maintain the voice coil in proper alignment while permitting axial reciprocation thereof.

2. A loudspeaker comprising:

a magnetic assembly forming an annular flux gap;

a frame having a peripheral flange adapted for mounting the loudspeaker in a suitable baffle, and walls extending rearwardly from the flange and forming a cylindrical liquid container disposed around the magnetic assembly and spaced therefrom to form an annular space, an acoustic radiator assembly peripherally suspended within the frame, and having a voice coil reciprocally disposed in the annular flux gap, the voice coil being adapted to acoustically excite the acoustic radiator assembly in response to a current flowing therein; and an adhesive hardened from a liquid state disposed in the annular space and circumferentially bonding the magnetic assembly to the walls of the frame.

3. The loudspeaker as set forth in claim 2 wherein:

the magnetic assembly comprises a back pole plate disposed adjacent to the base, a generally toroidal-shaped permanent magnet disposed forward from the back pole plate, a generally toroidal-shaped front pole plate disposed forward from the magnet, a cylindrical center post generally axially disposed within the magnet and front pole plate, and means for supporting the center post in axial alignment relative to the front pole plate such that the annular flux gap is uniformly dimensioned and generally axially aligned with respect to the frame.

4. The loudspeaker as set forth in claim 3 further comprising:

means cooperatively arranged within the walls for locating the magnetic assembly in generally coaxial alignment relative to the frame prior to bonding the magnetic assembly to the walls.

5. The loudspeaker as set forth in claim 4 wherein:

the locating means comprises rib members integrally formed with the frame on inner surfaces of the walls, and the walls of the frame are generally frusto-conical in shape with the diameter thereof decreasing while moving rearward.

6. The loudspeaker as set forth in claim 5 wherein:

the rib members are regularly spaced between recessed webs which permit the adhesive material when in its liquid state to flow between adjacent ribs to the rearward end of the frame, and further comprising means disposed rearward of the ribs and projecting radially inward for aligning the back pole plate with respect to the frame.

7. The loudspeaker as set forth in claim 6 wherein the base comprises a circular membrane peripherally affixed to the rearward end of the walls of the frame.

8. The loudspeaker as set forth in claim 6 wherein the base comprises a circular member integrally formed with the frame at the rearward end of the walls.

9. The loudspeaker as set forth in claim 8 wherein the frame is a unitary construction, the material of which being selected from the group consisting of injection molded plastic and cast alumium.

10. The loudspeaker as set forth in claim 6 further comprising:

a terminal block having a first portion embedded in the adhesive material to rigidly secure the terminal block therein and a second portion extending forward from the adhesive material, the second portion being equipped with a metal terminal and means for making connection between the metal terminal and a lead to the voice coil.

11. The loudspeaker as set forth in claim 6 further comprising:

a second front pole plate disposed between the magnet and the first-mentioned front pole plate, a second back pole plate disposed between the magnet and the first-mentioned back pole plate, wherein the second back pole plate is preassembled with the center post, and the second front and back pole plates have diameters less than that of the magnet but greater than that of the respective adjacent first-mentioned pole plates.

12. A method of making a loudspeaker comprising the steps:

placing a basket frame on a horizontal surface, the basket frame having a liquid container portion adapted to receive a magnetic assembly for a loudspeaker and provide an annular space around the magnetic assembly adapted to hold a liquid adhesive, the basket frame also forming an annular flange portion connected to and coaxial with the liquid container portion for supporting the flexible surround of a loudspeaker coil-cone assembly, assembling a center post in coaxial alignment with a back pole plate, placing the assembly of the center post and back pole plate in the liquid container portion of the frame such that the center post is coaxially aligned with respect to the flange portion by means disposed inside the liquid container portion for locating the peripheral edges of the back pole plate and thus the center post, placing a magnet on the back pole plate and around the center post in generally coaxial alignment therewith, placing a front pole plate around the center post using a tool to maintain precise annular spacing between the front pole plate and the center post, pouring a liquid adhesive into the annular space formed within the container portion and around the peripheral edges of the magnet and pole pieces, allowing the liquid adhesive to harden into a solid mass, removing the tool, placing an acoustic coil-cone assembly in the frame so that a voice coil at a rearward end of the coil-cone assembly extends into and is coaxially aligned within the space between the front pole plate and the center post, and securing the flexible surround of the coil-cone assembly to the peripheral flange portion of the acoustic radiator assembly to maintain the coil-cone assembly in the frame while permitting axial reciprocation thereof.

13. The method of claim 12 wherein the basket frame is formed by molding to form a cylindrical, open-ended liquid container portion, and the bottom of the container is closed by placing an adhesive backed thin label over the open end whereby the label will also be adhered to the back pole plate after the back pole plate is placed in the frame.

* * * * *